US005135367A

United States Patent [19]

Finsterwalder et al.

[11] Patent Number: 5,135,367

[45] Date of Patent: Aug. 4, 1992

[54] FUEL INJECTOR

[75] Inventors: Gerhard Finsterwalder, Bergisch Gladbach; Reda Rizk, Cologne; Hans G. Michels, Erftstadt, all of Fed. Rep. of Germany

[73] Assignee: Kloeckner-Humboldt-Deutz AG, Cologne, Fed. Rep. of Germany

[21] Appl. No.: 518,141

[22] Filed: May 3, 1990

[30] Foreign Application Priority Data

May 3, 1989 [DE] Fed. Rep. of Germany ..... 3914582

[51] Int. Cl.[5] ..... F04B 7/04; F02M 41/08

[52] U.S. Cl. ..... 417/495; 417/494; 417/499; 123/449

[58] Field of Search ..... 123/447, 449, 503, 506; 417/490, 494, 495, 499

[56] References Cited

U.S. PATENT DOCUMENTS 1,640,579 8/1927 Severin ..... 123/503

2,101,221 12/1937 L'Orange ..... 417/494

2,633,082 3/1953 McFarland ..... 417/494

FOREIGN PATENT DOCUMENTS 356078 1/1938 Italy ..... 417/495

*Primary Examiner*—Leonard E. Smith
*Assistant Examiner*—Michael I. Kocharov
*Attorney, Agent, or Firm*—Charles L. Schwab

[57] ABSTRACT

A fuel injector for diesel engines, having at least one pump plunger (1), which is sealingly guided in a plunger bushing (2) and, together with said bushing, defines a high-pressure space (5). The pump plunger (1) has an internal suction valve (6) which creates a fuel injection pump having a small dead volume in the high-pressure region and low construction cost. The suction valve (6) may be provided with a cone-shaped compression spring (7) disposed in the high-pressure region (5) or with a stroke limiting stop (28, 28*a*).

3 Claims, 3 Drawing Sheets

FUEL INJECTOR

TECHNICAL FIELD

This invention relates to a fuel injector for diesel engines.

PRIOR ART STATEMENT

Federal German Patent DE-PS 90 11 20 describes a fuel injector having a suction valve in a pump plunger together with a compression spring disposed in the high-pressure space of the fuel injector and loading the suction valve.

A fuel injector having a suction valve offers the advantage that the high-pressure space is always connected to the fuel pressure of the suction space during the suction stroke of the pump plunger, by virtue of which no voids can form in the high-pressure space.

The arrangement of the compression spring in the high-pressure space offers the advantage that the suction valve can be constructed small and therefore can also be placed in pump plungers having a relatively small diameter.

Disadvantageous, however, is a large dead volume in the high-pressure space, brought about by the compression spring, which dead volume has a detrimental effect or the attainable peak pressures in fuel injection. While this disadvantage can be avoided by means of an arrangement of the spring in the pump plunger itself, this solution is unsuitable for pump plungers having a small diameter.

OBJECTS AND BRIEF SUMMARY OF THE INVENTION

It is the object of the invention to create a fuel injector having a suction valve, which fuel injector has a small dead volume in the high-pressure space and also permits the use of a small pump plunger.

This object is achieved by virtue of the characterizing clauses of claims 11 and 14. Both embodiments make possible, in accordance with the invention, a fuel injector that effects a minimal dead volume in the high-pressure region of the fuel injector and is also suitable for small pump plungers.

By means of an advantageous development of one embodiment of the invention the turns of the cone-shaped compression spring are pushed one into another during the upward motion of the pump plunger, thus minimizing the dead volume of the cone-shaped compression spring in the compressed condition. It can be advantageous in this context to make the cone-shaped compression spring with only one turn. Cases are, however, conceivable in which several spring turns are advantageous. The spring turns here can exhibit equal or unequal slopes. By means of this arrangement it is achieved that the cone-shaped compression spring is compressed, during the upward motion of the pump plunger, into a disk having the diameter of said plunger. Thus, the cone-shaped compression spring occupies practically no additional deal volume.

The cone-shaped compression spring is normally stamped out of a spring-steel blank. It can, however, also be advantageous to fabricate it of plastic.

By means of the design of the valve cone in accordance with the invention, a smooth pump plunger end surface is achieved, which represents an important precondition for minimizing the dead volume in the high-pressure area.

By means of an advantageous development of the invention, a self-centering suction valve is realized without special guide elements. In special cases, however, it can be advantageous to provide a cylindrical guide for the valve cone below the valve seat, with either a longitudinal and a transverse hole being provided in the cylindrical guide, or grooves being provided at its periphery for the further conveyance of fuel.

In another embodiment of the invention the suction valve in the pump plunger is opened and closed without a spring, solely by means of utilizing the inertia of the suction valve body and the pressure difference between the high-pressure space and the suction space of the fuel injector. The stroke motion of the suction valve body is limited by means of stroke limiting means.

An advantageous development creates a small dead volume by means of the arrangement of the round pin and of the valve cone end surface in accordance with the invention. In this embodiment, the stroke limiting means is particularly easy to mount, since the round pin used has no contact with the sliding surface of the plunger bushing.

In another embodiment of the invention a pin having a square cross section and used as stroke limiter is arranged flush in the valve end surface, thus permitting a particularly shallow depth of the rectangular groove in the valve cone floor.

Both embodiments of the stroke limiting means offer the advantage that they require no sealing against the high pressure space, since they are located in said space.

Additional stroke limiting means are conceivable, for example a stop ring above the valve cone end surface or below the valve cone. All solutions having stroke limiting means require no compression spring.

It is even conceivable to dispense with stroke limiting means in the pump plunger altogether and to use the seal of the high-pressure space as stroke limiting means. In this case, a sufficiently long guidance must be provided for the suction valve body in the pump plunger so that said guidance is also insured in the case of the maximum possible stroke. If appropriate, a cam having no return stop can also be desirable.

An advantageous development of the invention effects a positive flow connection of the high-pressure space with the suction space of the fuel injector during the point in time when the delivery hole is still closed by the pump plunger. Furthermore, the annular space serves as a leakage oil return guide, by which means dilution of the lubricating oil by fuel is prevented.

By means of a development of the suction valve body in accordance with the invention, exact guidance and thus positive sealing of the suction valve is achieved, which is crucially important for the functional reliability of the fuel injector.

By means of an advantageous development of the invention, the dead volume in the high-pressure region of the fuel injector is again made decisively smaller. The precondition for the omission of the delivery valve is the suction valve in accordance with the invention, by means of which an overpressure equal to the suction-space pressure is always insured in the high-pressure space during the downward motion of the pump plunger. By this means, despite the lack of a delivery or pressure-relief valve, relief of the pressure in the injection line to the suction-space pressure is achieved, and sucking empty of the injection line and the formation of voids is prevented.

The arrangement in accordance with the invention leads to a particularly simple design having low fabrication and maintenance cost, which is also suitable for small pump plungers. Furthermore, the small dead volume makes for a high hydraulic stiffness, which permits high injection pressures as are required by modern diesel motors to achieve complete combustion and acceptable quality emission.

BRIEF DESCRIPTION OF THE DRAWINGS

Further features of the invention are derived from the description that follows and from the drawings, in which exemplary embodiments of the invention are illustrated schematically.

DETAILED DESCRIPTION OF THE DRAWINGS

Figure 1:
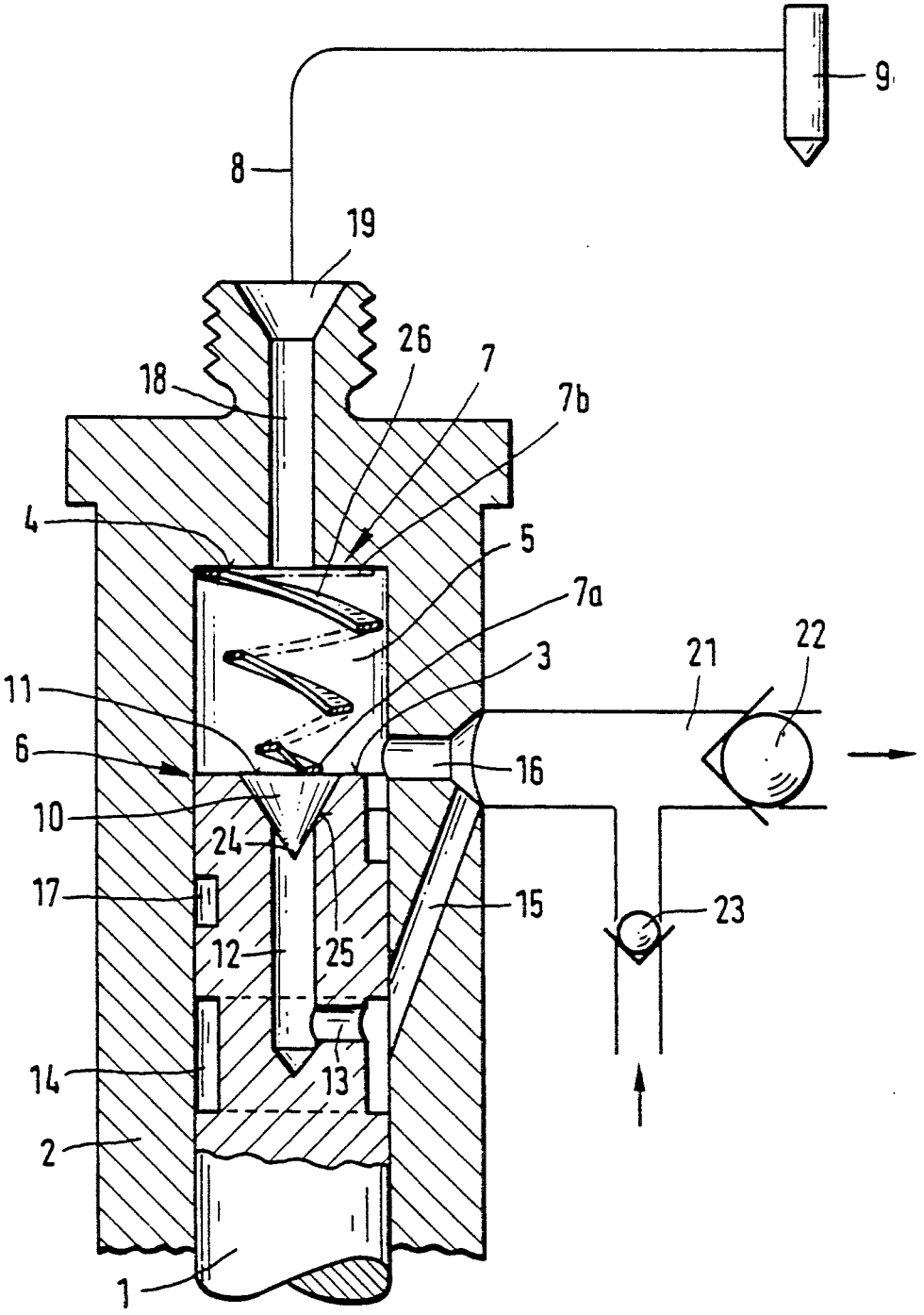
FIG. 1 shows a cross section through the fuel injector in accordance with the invention, having a suction valve 6 in the pump plunger 1 and a cone-shaped compression spring 7 in the high-pressure space 5.

The fuel injector of FIG. 1 consists of, among other things, a plunger bushing 2 with a bore in which a pump plunger 1 is sealingly guided. The plunger bushing 2 is closed at the high-pressure end by means of a plunger bushing end wall 4, from which a high-pressure passage 18 leads to a pressure connection 19. A delivery hole 16 is situated in the plunger bushing 2 in the region of the bottom dead center position of the pump plunger 1, from which delivery hole branches a connecting line 15 located in the plunger bushing 2 and running obliquely toward the pump plunger 1.

The delivery hole 16 opens into a suction space 21, which is supplied with fuel by a low-pressure pump, not illustrated, via a delivery valve 23 and is held at a certain admission pressure by means of a pressure-maintaining valve 22. The delivery valve 23 and the pressure-maintaining valve 22 are made with particularly tight seals in order to prevent draining of the fuel injector when the internal-combustion engine is idle, thus preventing the difficulties in starting which result from such draining.

The pump plunger 1 has a pump plunger end or end surface 3, into which the conical valve seat 25 of a suction valve body 10 is recessed. The suction valve body 10 has a valve cone end surface 11, which together with the pump plunger end surface 3 forms a smooth surface when the suction valve 6 is closed.

From the valve seat 25 of the suction valve 6 originates a plunger hole 12 from the end of which hold branches a transverse 13. The transverse hole 13 opens into an annular space 14 in the form of a recess in the periphery of the pump plunger 1, which annular space is in flow connection with the connecting line 15 at least in that stroke area of the pump plunger 1 in which high-pressure delivery takes place.

Between the annular space 14 and the pump plunger end 3 there is an oblique control groove 17, in flow connection with said annular space, which control groove, in cooperation with the delivery hole 16, serves to control the injection quantity in known fashion by means of rotation of the pump plunger 1.

The pump plunger 1 and the plunger bushing 2 define a high-pressure space 5. A cone-shaped compression spring 7 having a rectangular or square spring-wire cross section is arranged in the high-pressure space 5. The first turn of the cone-shaped compression spring 7, which represents the blunt end of said spring and which has a diameter approximately the same as the inside diameter of the plunger bushing 2, bears on the plunger bushing end 4. The last turn of the cone-shaped compression spring 7, which represents the pointed end of said spring, presses against the valve cone floor 11.

The high-pressure space 5 is in intermittent flow connection with an injection valve 9 via the high-pressure passage 18, the pressure connection 19 and the injection line 8, and with a suction space 21 via the delivery hole 16 and the connecting line 15, respectively, such connection specifically existing only when no high-pressure delivery is taking place.

OPERATION

The fuel injector functions as follows:

At the beginning of the upward motion of the pump plunger 1, the suction valve 6 is closed. After the closure of the suction hole 16, the upward movement of the pump plunger 1 causes high-pressure delivery of fuel. The fuel is displaced out of the high-pressure space 5 and flows between the turns of the cone-shaped compression spring 7, via the high-pressure passage 18, the injection line 8 and the injection valve 9, into the combustion space, not illustrated.

During the upward motion of the pump plunger 1, the cone-shaped compression spring 7 is compressed so that it forms a disk at the top dead center position of the pump plunger 1. The spring turns are shaped such that only a minimal clearance, and thus only a minimal dead space, is present between them in the compressed state.

High-pressure delivery continues until the upper edge of the oblique control groove 17 moves past the delivery hole 16. By means of the flow connection thus established via the control groove 17 between the high-pressure space 5 and the suction space 21, the pressure in the high-pressure region of the fuel injector is relieved into the suction space 21. The fuel that is still being delivered after the completion of injection up until the top dead center position of the pump plunger 1 flows back into the suction space 21 in the same way.

During the downward motion of the pump plunger 1, said plunger first draws fuel out of the suction space 21, via the control groove 17 and the delivery hole 16.

After the delivery hole 16 is again closed by means of the upper control edge of the control groove 17, the suction valve 6 opens because of the overpressure in the suction space 21 and supplies fuel to the high-pressure space 5 via the connecting line 15, the annular space 14, the transverse hole 13, and the plunger hole 12.

After the delivery hole 16 is uncovered by the upper control edge of the pump plunger end 3, the high-pressure space 5 is again directly connected to the suction space 21 so that the suction valve 6 closes because of the lack of a pressure difference. The suction valve 6 then is open only as long as the delivery hole 16 is closed during the downward motion of the pump plunger 1.

The suction valve 6 is closed prior to the beginning of high-pressure delivery. Said high-pressure delivery begins by means of closure of the delivery hole 16. In this way, exact quantity and accurate timing of injection are insured.

As the suction valve 6 is opened and closed by a small differential in pressure, it is subject to no significant load and thus to little or no wear.

An important advantage of the suction valve 6 is the fact that there is no vacuum in the high-pressure space 5 during the downward motion of the pump plunger 1. A delivery valve or pressure-relief valve in the high-pressure region of the fuel injector can therefore be dispensed with, without the injection line 8 being sucked empty and without formation of a void. The supply pressure of the suction space, to which the pressure in the high-pressure region is relieved, always prevails in the high-pressure region of the fuel injector during the downward motion of the pump plunger 1.

By omitting a delivery valve in the high-pressure region of the fuel injection pump, and by using the suction valve 6 in accordance with the invention, a minimal dead volume is achieved, thus permitting a high injection pressure, as is desired in modern diesel motors.

A further important advantage of the invention is the simplicity of design. This is characterized by a simple suction valve body 10, which can also be placed in small pump plungers 1, or in a conventional pump plunger design in which the annular space 14 together with the connecting line 15 simultaneously takes over the function of the leakage oil return and in which the delivery valve and its screw connection are replaced by an integrated pressure connection 19. By means of all these measures, the fuel injector in accordance with the invention is made simpler and less expensive to fabricate and maintain in comparison with a conventional design.

Figure 2A:
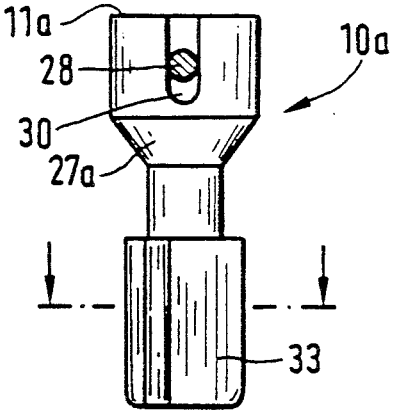
FIG. 2*a* shows a view of the suction valve body 10*a* having a groove 30 and the pin 28 therein.
Figure 2B:
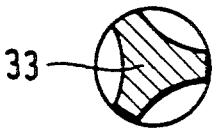
FIG. 2*b* shows a section through a guide part 33 of the suction valve body 10*a*, 10*b*.
Figure 2:
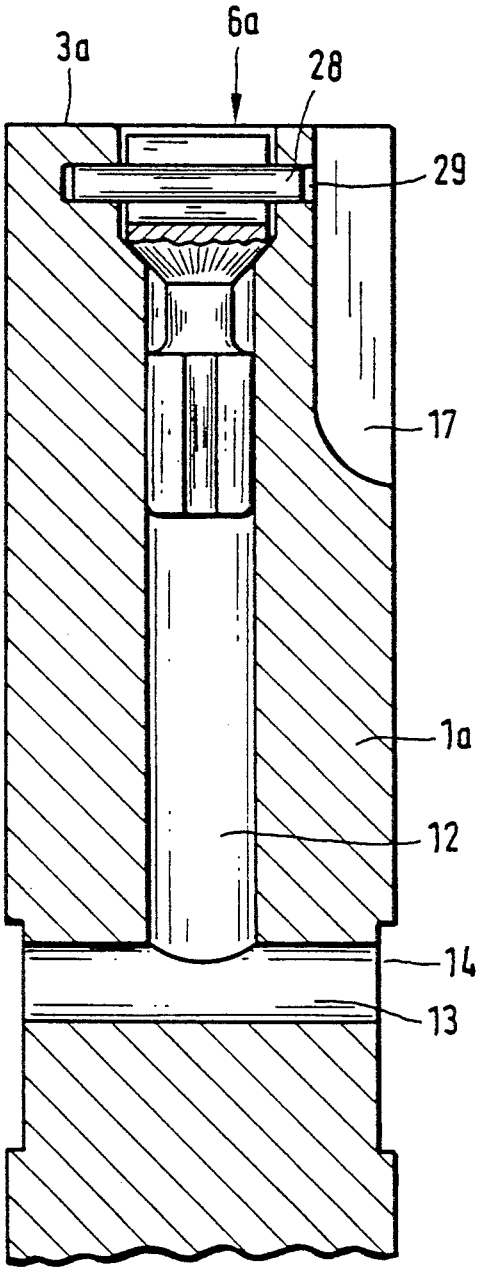
FIG. 2 shows a section through a pump plunger 1*a* having a suction valve 6*a*, a suction valve body 10*a*, and a pin 28 having a round cross section.
Figure 3A:
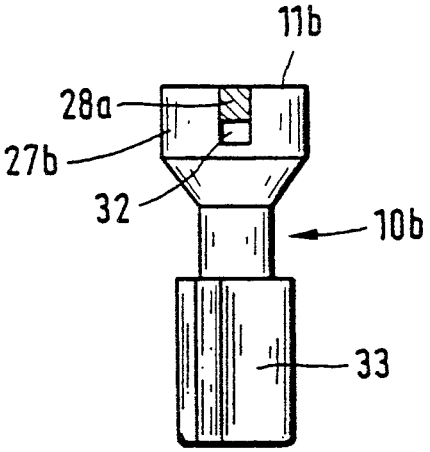
FIG. 3*a* shows a view of the suction valve body 10*b* having a rectangular groove 32 and the pin 28*a* therein.
Figure 3:
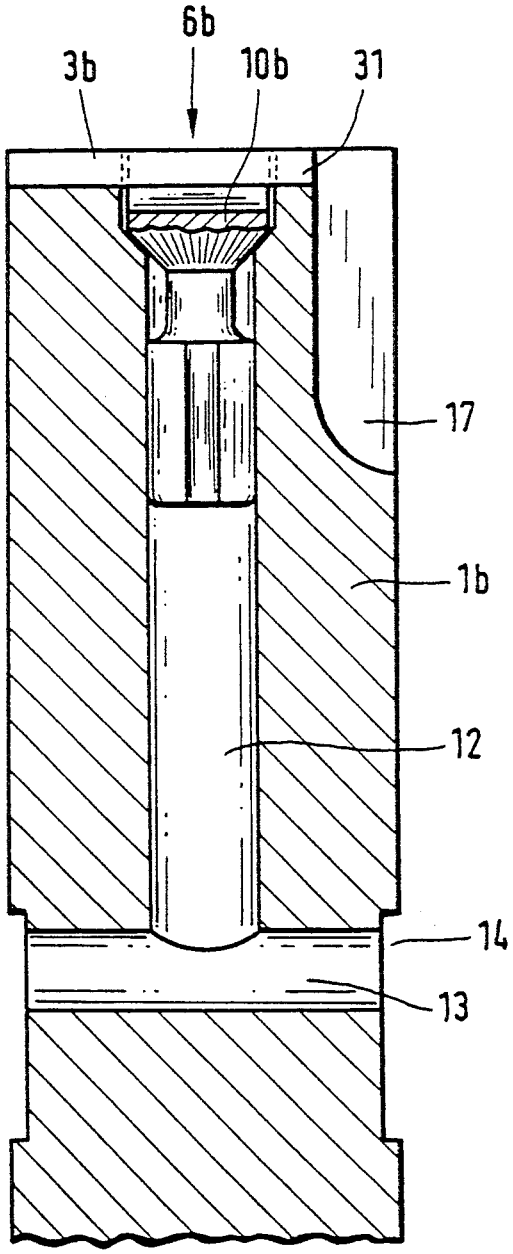
FIG. 3 shows a section through a pump plunger 1*b* having a suction valve 6*b*, a suction valve body 10*b*, and a pin 28*a* having a square cross section.

A further possibility for implementing a suction valve in the pump plunger, which suction valve saves space and does not cause a large dead volume, is illustrated in FIG. 2 and FIG. 3. In these solutions, a suction valve 6*a*, 6*b* is provided with a valve body 10*a*, 10*b*, whose stoke motion is not controlled by a spring but is limited by an abutment in the form of a pin 28, 28*a*.

The pin 28 having round cross section is arranged with a light driving fit in a pin hole 29. The pin hole 29 is located slightly below the pump plunger floor 3*a*. It intersects the axis of the pump plunger 1*a*.

The pin 28*a* having square cross section is mounted in a pin groove 31 having the same cross section in the region of the pump plunger floor 3*b*. The mounting is done by welding, preferably by means of laser beam welding.

The pin 28 having the round cross section is in an operative sliding fit connection with a groove 30 of a valve cone 27*a* of the suction valve body 10*a*, and corresponding the pin 28*a* having the square cross section is in an operative sliding fit connection with a rectangular groove 32 of a valve cone 27*b* of the suction valve body 10*b*.

The suction valve bodies 10*a*, 10*b* include a guide part 33 having the axial grooves illustrated in FIG. 2*b* for the flow of fuel.

The guide part 33 is guided in the plunger hole 12. Said guide part affords exact guidance of the suction valve body 10*a*, 10*b* and thus provides positive closing of the suction valves 6*a*, 6*b*.

The opening and closing motion of the suction valve bodies 10*a*, 10*b* is initiated by the inertia of said valve bodies in connection with the stroke motion of the pump plungers 1*a*, 1*b*, and is intermittently sustained by means of the pressure difference between the high-pressure space 5 and the suction space 21. After injection is completed, the pump plunger 1*a*, 1*b* decreases its velocity to zero, while the suction valve bodies 10*a*, 10*b* continue moving at the high plunger velocity and in this fashion open the suction valves 6*a*, 6*b*. Said suction valves remain open during the downward stroke of the pump plunger 1*a*, 1*b*, sustained by means of the pressure difference between the high-pressure space 5 and the suction space 21. The same holds, and exactly, for the portion of the pump plunger stroke in which the delivery hole 16 is covered by the pump plunger 1*a*, 1*b*. By this means, in the solutions of FIGS. 2 and 3 as well, the formation of a vacuum in the high-pressure space 5 and thus the sucking of fuel out of the injection line 8 is positively prevented. A minimum pressure equal to the pressure in the suction space always prevails in the high-pressure space 5.

At the lower end of the suction stroke of the pump plunger 1*a*, 1*b*, the plunger velocity of said plunger again decreases to zero so that the suction valve bodies 10*a*, 10*b* again move toward the valve seat and close the suction valves 6*a*, 6*b*. Here again, the beginning of delivery in the next delivery stroke is exactly and reproducibly determined by means of the closure of the delivery hole 16 by the pump plunger 1*a*, 1*b*.

The embodiments of the invention in which an exclusive property or privilege is claimed are defined as follows:

1. In a fuel injection system for a diesel engine including: a source of fuel including a low pressure space, an injection valve (9), an injection pump having a plunger bushing (2) with a bore extending to an end wall and a pump plunger (1) sealingly guided in said bore and having an end (3) which together with said bore and said end wall define a high pressure space (5) and an injection line (8) interconnecting said high pressure space (5) and said injection valve (9), the combination comprising:

a conically shaped valve seat (25) formed in said end (3) of said pump plunger (1), a low pressure passageway interconnecting said valve seat (25) with said low pressure space, a suction valve (5) in said pump plunger (1) including a suction valve body (10) having a conically shaped portion (27) shiftable axially through a predetermined stroke between a closed position in which it is seated in said conically shaped valve seat (25) thereby preventing fuel flow from said high pressure space (5) to said passageway and an open position in which it is spaced from said seat and said high pressure space is connected in fluid communication with said low pressure space via said passageway, said conically shaped portion having a generally flat end in generally parallel and closely adjacent relation to said end of said pump plunger and a cone shaped compression spring disposed in said high pressure space and having a pointed end in axial thrust transmitting engagement with said flat end of said conically shaped portion of said valve body and a blunt end in axial thrust transmitting engagement with said end wall of said bore.

2. The fuel injection system of claim 1 wherein said cone shaped compression spring (7) is made from a spring wire having a generally rectangular cross section which compresses to an approximately flat disk at the top dead center position of said pump plunger (1), the outside diameter of said blunt end (7*b*) of said cone-shaped compression spring (7) approximately corresponding to the diameter of said pump plunger (1), and the individual turns (26) of said spring having minimal clearance relative to one another when compressed to said flat disk condition.

3. The fuel injection system of claim 1 wherein said flat end (11) forms an approximately continuous smooth surface with said pump plunger end (3) when said conically shaped portion is in its closed position.

* * * * *